US007448818B2

(12) United States Patent
Miralles De Imperial Mora-Figueroa

(10) Patent No.: US 7,448,818 B2
(45) Date of Patent: Nov. 11, 2008

(54) FILE FOLDER

(76) Inventor: Fernando Miralles De Imperial Mora-Figueroa, Avda. de Andalucia, 76, 3 A, Cadiz 11008 (ES)

( * ) Notice: Subject to any disclaimer, the term of this patent is extended or adjusted under 35 U.S.C. 154(b) by 270 days.

(21) Appl. No.: 11/229,014

(22) Filed: Sep. 16, 2005

(65) Prior Publication Data

US 2007/0196163 A1 Aug. 23, 2007

(51) Int. Cl.
*B42F 3/00* (2006.01)
*B42F 13/02* (2006.01)
*B42F 13/00* (2006.01)

(52) U.S. Cl. ..... 402/13; 402/7

(58) Field of Classification Search ..... 402/8, 402/13, 14, 16–19, 21, 22, 60–63, 68, 80 P; D19/26, 27; 281/21.1, 24, 28
See application file for complete search history.

(56) References Cited

U.S. PATENT DOCUMENTS

| | | | | | |
|---|---|---|---|---|---|
| 964,811 | A * | 7/1910 | Robinson | 402/7 |
| 1,780,429 | A * | 11/1930 | Manning | 402/61 |
| 3,340,635 | A | 9/1967 | McIntosh | |
| 4,309,046 | A * | 1/1982 | Giulie | 281/21.1 |
| 4,606,666 | A | 8/1986 | Patton | |
| 4,874,186 | A * | 10/1989 | Groswith, III et al. | 281/28 |
| 5,722,783 | A * | 3/1998 | Kiyomi | 402/70 |
| 6,076,990 | A * | 6/2000 | Jahn | 402/70 |
| 6,663,310 | B2 * | 12/2003 | Han | 402/8 |
| 6,736,563 | B1 * | 5/2004 | With | 402/60 |
| 2004/0052572 | A1 * | 3/2004 | Peters | 402/60 |
| 2004/0213630 | A1 * | 10/2004 | Leibman | 402/70 |

FOREIGN PATENT DOCUMENTS

| | | |
|---|---|---|
| ES | 429086 | 8/1976 |
| FR | 2 5050262 | 11/1982 |
| FR | 2 787 387 | 6/2000 |
| GB | 333 439 | 8/1930 |
| GB | 1 443 113 | 7/1976 |

OTHER PUBLICATIONS

International Search Report dated Jun. 21, 2004, from the corresponding International Application.

* cited by examiner

*Primary Examiner*—Derris H Banks
*Assistant Examiner*—Pradeep C Battula
(74) *Attorney, Agent, or Firm*—Katten Muchin Rosenman LLP

(57) ABSTRACT

Of the type of those which incorporate a portfolio (1), with its front wall (2), its rear wall (3) and its spine (4), to which is coupled a plurality of sheets or documents (9) provided with holes (10) next to one of their edges, it incorporates a narrow plate (5) joined to the internal face of its rear wall (3), next to its spine (4), from which plate (5) emerges a plurality of narrow toothed strips (6) of which are complementary respective headers (8) joined in turn to a second strip (7), physically independent of the portfolio (1), so that after coupling the sheets or documents (9) to the toothed strips (6), by passing these through the holes of the former, said toothed strips (6) are finally coupled to the headers (8) of the moveable plate (7), whereby the sheets (9) are definitively fastened and it is possible to proceed to the cutting of the surplus segment of said toothed strips (6).

2 Claims, 3 Drawing Sheets

FILE FOLDER

OBJECT OF THE INVENTION

The present invention refers to a file folder, of the type of those which incorporate a cover to which, in the proximity of its spine and generally on its rear wall, a plurality of sheets or documents is fastened, provided with holes for said fastening.

The object of the invention is to achieve a perfect fastening for the mentioned sheets or documents, so that they are firmly secured to the spine of the file folder, as if they were bound, allowing repeated turning of the same without any risk of tearing due to the fastening holes.

BACKGROUND OF THE INVENTION

When filing documents, be they loose sheets, brochures or the like, it is habitual to use file folders which constitute a kind of portfolio, with a front wall, a rear wall and a spine, so that to the internal face of the rear wall and in the proximity of the spine, a support is fastened provided with a plurality of openable rings, so that by perforating marginally and conveniently the sheets or documents to be filed, these can be coupled to the aforementioned rings, when these are open, and be secured when they are closed.

Independently of the high cost of these mechanisms, the fundamental problem with said type of file folders is centred on the fact that the documents must support the forces applied during their manipulation inside the portfolio through the narrow borders defined between their holes and the proximate and corresponding edge, whereby tearing occurs frequently in such documents which, besides signifying a deterioration in the same, sometimes causes their escape or detachment from the file folder.

In an endeavour to overcome this problem, the use is known of adhesive rings to strengthen the holes in the sheets, which constitutes a very complicated and difficult to manage solution and, in a more habitual fashion, fitting the rings of the file folder with a page press, with a means for locking which presses the marginal area of the sheets against the back wall of the portfolio and which, as a consequence, prevents the tensile stress on the sheets from concentrating on their fastening holes, which solution makes the cost of said type of file folder still higher.

DESCRIPTION OF THE INVENTION

The file folder which the invention proposes resolves the problem explained above in a fully satisfactory manner, constituting an extraordinarily simple and effective solution.

To this end and in more specific terms, said file folder, based on a basic portfolio with any conventional structure, centres its characteristics on the fact that in the proximity of the spine thereof it incorporates a narrow plate joined immovably to the portfolio, from which a longitudinal and middle alignment of toothed, evenly distributed strips emerges perpendicularly, in positions equivalent to those that in a classic file folder would be adopted for the also classic rings, toothed strips made of plastic, of the type habitually employed in the production of straps also of plastic.

The file folder is supplemented with a second plate, this one physically independent of the folder, in which in turn are integrated a plurality of small headers with at least one interior tooth, complementary to the aforementioned toothed strips, numerically and positionally coincident with the latter and capable of being displaced along said toothed strips in the closing direction between the two plates, obviously with the interposition of the bundle of sheets to be filed, but inhibited for displacement in the opposite direction.

In accordance with the aforesaid, the documents to file are easily coupled on the toothed strips of the plate joined to the portfolio by passing said strips through the marginal holes of the latter, and after the collocation of all the documents which are to be part of the file folder, the assembly of the second plate and a convenient tightening of the same against the first one, assures a perfect fastening for the documents, after which the remaining or surplus segments of said toothed strips can be eliminated, by cutting the same at the level of the corresponding headers.

As a complement to the described structure, it has been foreseen that to the front wall of the portfolio, also on the internal face thereof and in a situation confronting the plate of its rear wall, another plate is fastened, in this case provided with housings to hold therein the mentioned headers in the closed condition of the file folder after the same has been filled.

Evidently the plate carrying the toothed strips can be associated with the front wall of the portfolio instead of with the rear wall, or said toothed strips can even be mounted on the plate physically independent of the portfolio, in which case said strips must cross through the body of the portfolio, to be finally cut level with the rear face of the same.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

PREFERRED EMBODIMENT OF THE INVENTION

Figure 1:
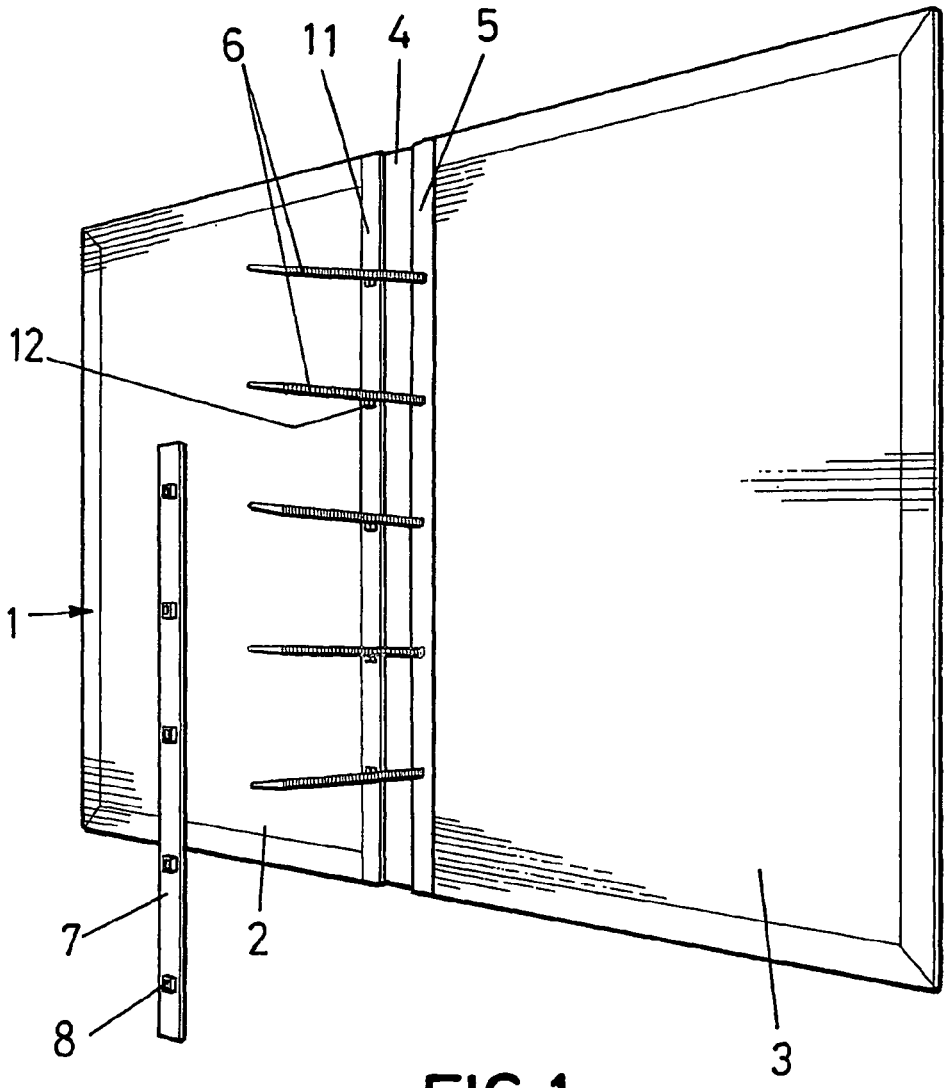
FIG. 1.—It shows, according to a view in perspective, a file folder implemented in accordance with the object of the present invention, in the empty condition for the same.
Figure 2:
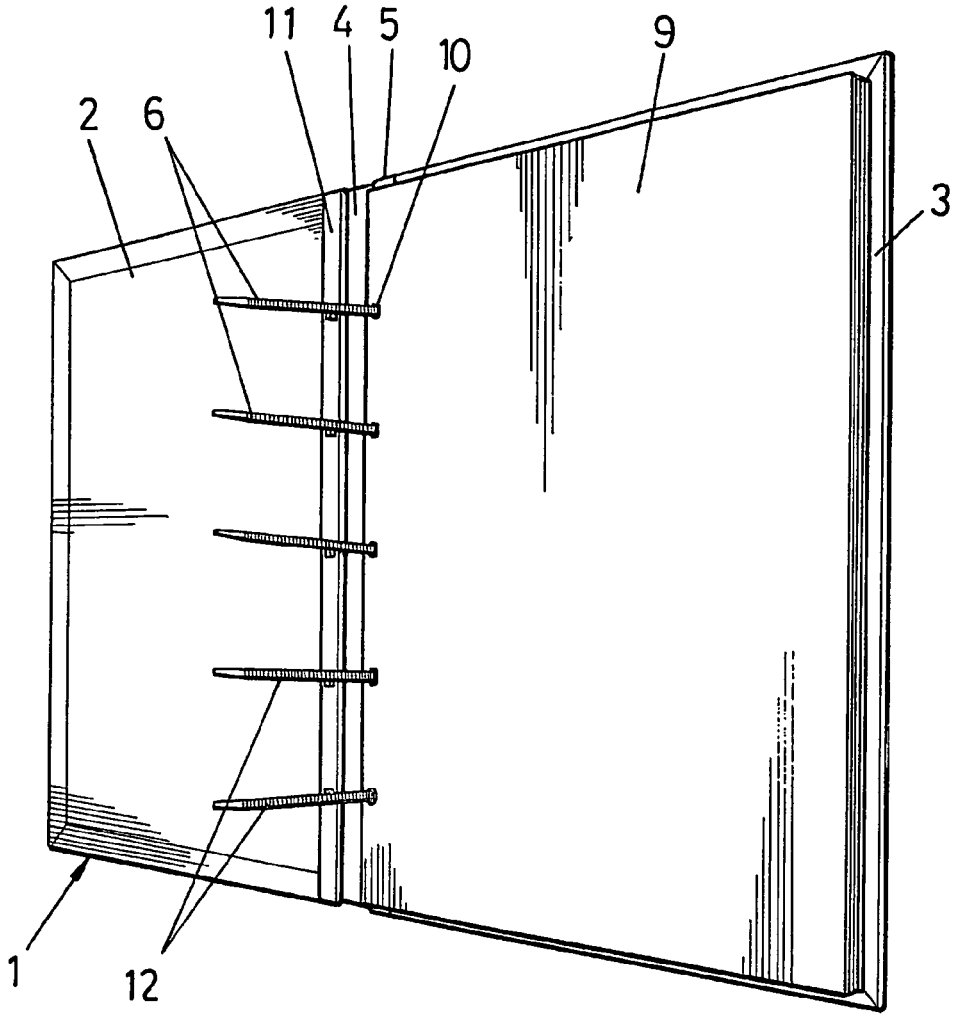
FIG. 2.—It shows another perspective of the same file folder, after having received a bundle of sheets or documents.
Figure 3:
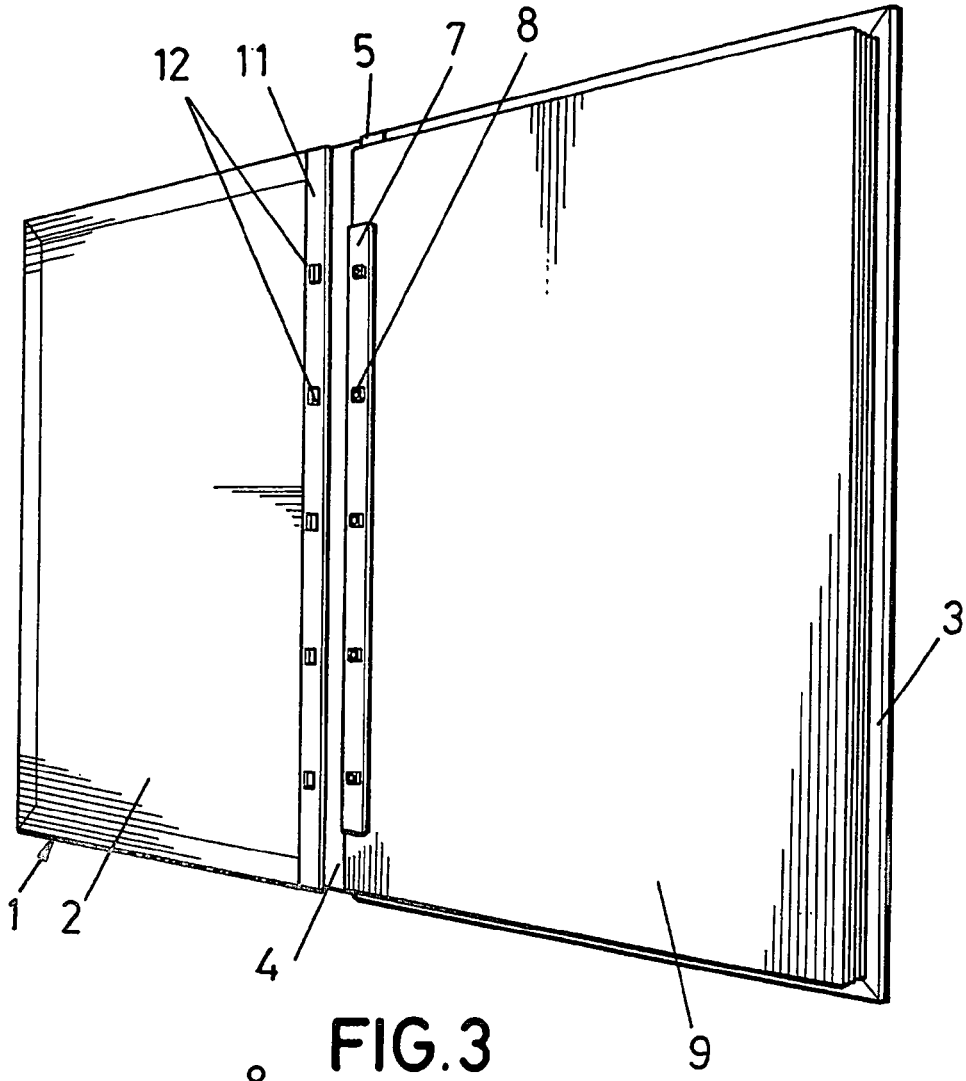
FIG. 3.—It shows a representation similar to FIG. 2, after coupling the plate carrying the complementary headers to the toothed strips.

In view of the aforementioned figures it can be observed how the file folder which the invention discloses is incorporated from a portfolio (1), of any conventional type, in which form part a front wall (2), a rear wall (3) and a spine (4), with the special particularity that to the rear wall (3) in the marginal area proximate to its spine (4), a narrow plate (5) is fastened, by means of adhesive, by thermo-welding or by any other means, inside which plate are embedded the heads of a plurality of toothed, plastic strips (6), evenly distributed along the plate (5) and emerging perpendicularly from the same.

As an independent accessory of the portfolio (1), the file folder incorporates a second plate (7), similar to the aforesaid plate (5), but which incorporates respective headers ( 8) in numerical and positional correspondence with the toothed strips (7), each header having one or more interior teeth, as is conventional, to allow the passage therethrough of the strips (6) in only one direction, and to cause the blocking of the same in the opposite direction.

The bundle of sheets or documents (9) to be filed, with their classic holes (10) also numerically and positionally coincident with the toothed strips (6), is coupled inside the file folder, that is to say inside the portfolio (1), by passing said toothed strips (6) through the holes (10), after which the repeatedly cited toothed strips (10) are subsequently passed through the headers (8) of the moveable plate (7), until reaching a limiting condition of pressure in which the fastening of the sheets (9) is perfectly guaranteed, at which point one can proceed to the elimination by cutting of the residual or surplus segments of the toothed strips (6), specifically level with the headers (8).

Figure 4:
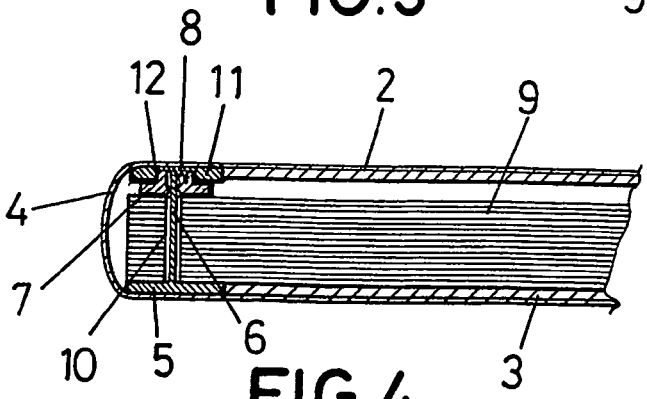
FIG. 4.—It shows, finally, a detail in cross section of the file folder of the previous figure, in the closed condition and at the level of its spine.

The structure described is completed with a third plate (11), similar to the previous ones, conveniently fastened to the marginal area of the front wall of the portfolio (1), in the proximity of the spine (4), with the particularity that said plate (11) incorporates recesses or housings (12), numerically and positionally suitable for the headers (8) of the plate (7), and dimensionally appropriate to receive therein said headers, so that in the closed condition of the full file folder the headers (8) fit in the recesses (12), as is especially observed in FIG. 4, determining optimum closed conditions for the file folder.

The invention claimed is:

1. A file folder for fastening a plurality of sheets, each sheet comprising a plurality of holes located next to an edge of the sheet, the file folder comprising:

a portfolio comprising a front wall, a rear wall and a spine;

a fastening assembly for the plurality of sheets, the fastening assembly comprising a first plate attached to one of the front and rear walls in a position proximal to the spine, a plurality of spaced-apart toothed narrow strips perpendicularly upright from the first plate;

a second plate comprising a plurality of headers, each of the plurality of headers for mating with a respective one of the plurality of strips for clamping the plurality of sheets between the first and second plate;

a third plate attached to a respective other of the front and rear walls such that the first and third plate face are disposed on opposite sides of the spine, the third plate comprising a plurality of recesses, each of the plurality of recess for receiving a respective one of the plurality of headers, wherein each of the plurality of headers comprises a plurality of interior teeth, the teeth limiting movement of the strips in one direction to resist loosening pressure on the plurality of sheets and cause unintended tearing of the plurality of sheets; and wherein each of the plurality of strips comprise a material permitting each of the plurality of strips to be cut level with the respective header of the second plate.

2. The file folder of claim 1, wherein the first plate comprises an adhesive for attaching the first plate to the one of the front and rear walls by a user.

* * * * *

UNITED STATES PATENT AND TRADEMARK OFFICE

CERTIFICATE OF CORRECTION

PATENT NO. : 7,448,818 B2
APPLICATION NO. : 11/229014
DATED : November 11, 2008
INVENTOR(S) : Fernando Miralles De Imperial Mora-Figueroa It is certified that error appears in the above-identified patent and that said Letters Patent is hereby corrected as shown below:

The following are added to the Title page of the patent in the left column:

Item -- (63) Related U.S. Application Data

Continuation of application No. PCT/ES04/00120, filed on Mar. 16, 2004. --

Item -- (30) Foreign Application Priority Data

Mar. 17, 2003 (ES) .....P200300632 --

Signed and Sealed this
Twenty-ninth Day of May, 2012

David J. Kappos

David J. Kappos
*Director of the United States Patent and Trademark Office*